US010005595B2

(12) United States Patent
Liu

(10) Patent No.: US 10,005,595 B2
(45) Date of Patent: Jun. 26, 2018

(54) SEALING CAP

(71) Applicant: FREE-FREE INDUSTRIAL CORP., Taipei (TW)

(72) Inventor: Sheng-Yu Liu, Taipei (TW)

(73) Assignee: FREE-FREE INDUSTRIAL CORP., Taipei (TW)

( * ) Notice: Subject to any disclaimer, the term of this patent is extended or adjusted under 35 U.S.C. 154(b) by 39 days.

(21) Appl. No.: 15/243,691

(22) Filed: Aug. 22, 2016

(65) Prior Publication Data

US 2017/0190479 A1 Jul. 6, 2017

(30) Foreign Application Priority Data

Jan. 6, 2016 (TW) ..... 105200110 U

(51) Int. Cl.
*B65D 45/02* (2006.01)
*B65D 53/02* (2006.01)

(52) U.S. Cl.
CPC ..... *B65D 45/025* (2013.01); *B65D 53/02* (2013.01)

(58) Field of Classification Search
CPC ..... B65D 45/025; B65D 53/02
USPC ..... 220/233–238, 378, 262, DIG. 33
See application file for complete search history.

(56) References Cited

U.S. PATENT DOCUMENTS 283,588 A * 8/1883 Finsterer ..... B65D 39/12 215/294
326,641 A * 9/1885 Guptill ..... B65D 39/12 215/359
634,240 A * 10/1899 Hoyt ..... B65D 39/12 215/359
6,170,690 B1 * 1/2001 Hosoi ..... H01L 21/67373 206/445
2007/0241107 A1 * 10/2007 Matsumoto ..... B65D 39/12 220/238
2008/0179274 A1 * 7/2008 Cheng ..... A45F 3/16 215/329

* cited by examiner

*Primary Examiner* — James N Smalley
(74) *Attorney, Agent, or Firm* — Kirton McConkie; Evan R. Witt

(57) ABSTRACT

A sealing cap includes an outer cap, an inner cap and an air-tight gasket. The outer cap is to be disposed on a container. The inner cap is movably connected beneath the outer cap. The air-tight gasket is sleeved around the inner and outer caps. Two connectors extend through the outer cap and are connected to the inner cap. An operator is disposed above the outer cap and is pivotally connected to the connectors. The operator is operable to move the inner cap relative to the outer cap between a pressurizing position, where the inner cap pressurizes the air-tight gasket against the container, and an unpressurizing position, where the inner cap unpressurizes the air-tight gasket against the container.

7 Claims, 6 Drawing Sheets

SEALING CAP

CROSS-REFERENCE TO RELATED APPLICATION

This application claims priority to Taiwanese Patent Application No. 105200110, filed on Jan. 6, 2016.

FIELD

The disclosure relates to a container cap, and more particularly to a sealing cap to seal an opening of a container.

BACKGROUND

Referring to FIGS. 1 and 2, a conventional sealing cap, disclosed in Taiwanese Invention Patent No. I418508, is removably attached to a container 10. The sealing cap includes an outer cap 11, an inner cap 121, an air-tight gasket 122, a resilient member 13 and an operator unit 14. The outer cap 11 is configured to be disposed on the container 10, and includes two pivot portions 110 and a through hole 112 disposed between the pivot portions 110. Each pivot portion 110 has a slot 111. The inner cap 121 is movably connected beneath the outer cap 11. The air-tight gasket 122 is sleeved around the inner and outer caps 11, 121. The resilient member 3 is abuttingly disposed between the outer and inner caps 11, 121. The operator unit 14 includes a connector 141, an operator 142 and a pivot pin 143. The connector 141 extends through the through hole 112 and is connected to the inner cap 121. The operator 142 is pivotally connected between the pivot portions 110 of the outer cap 11 through the pivot pin 143 extending through the slots 111 of the pivot portions 110 and pivotally connecting the operator 142 to the pivot portions 110.

As shown in FIG. 2, when the operator 142 is placed upright on the outer cap 11 to move the inner cap 121 to an unpressurizing position, the inner cap 121 unpressurizes the air-tight gasket 122 against the container 10, and the pivot pin 143 abuts against bottom ends of the slots 111. When the operator 142 is rotated downward to abut against the lateral wall of the outer cap 11, the inner cap 121 is moved upwardly to a pressurizing position, such that the inner cap 121 pressurizes and deforms the air-tight gasket 122 against the container 10.

The conventional sealing cap is conveniently operable to removably seal the container 10. However, because the operator unit 14 and the resilient member 13 are centrally connected to the outer and inner caps 11, 121, the exerting force on the operator unit 14 and the urging force of the resilient member 13 may be localized at the center of the outer and inner caps 11, 121. In use, the conventional sealing cap may be subjected to an unbalanced force, which may cause the inner cap 121 to be oblique relative to the outer cap 11.

SUMMARY

Therefore, an object of the disclosure is to provide a sealing cap that can be kept in a balanced position when being operated.

According to the disclosure, a sealing cap is to be removably attached to a container, and includes an outer cap, an inner cap, an air-tight gasket, a resilient unit and an operator unit.

The outer cap is configured to be disposed on the container.

The inner cap is movably connected beneath the outer cap.

The air-tight gasket is sleeved around the inner and outer caps.

The resilient unit includes two spaced-apart first resilient members abuttingly disposed between the outer and inner caps.

The operator unit includes two spaced-apart connectors that extend through the outer cap and that are connected to the inner cap, and an operator that is disposed above the outer cap and that is pivotally connected to the connectors. The operator is operable to move the inner cap relative to the outer cap between a pressurizing position, where the inner cap pressurizes the air-tight gasket against the container, and an unpressurizing position, where the inner cap unpressurizes the air-tight gasket against the container.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
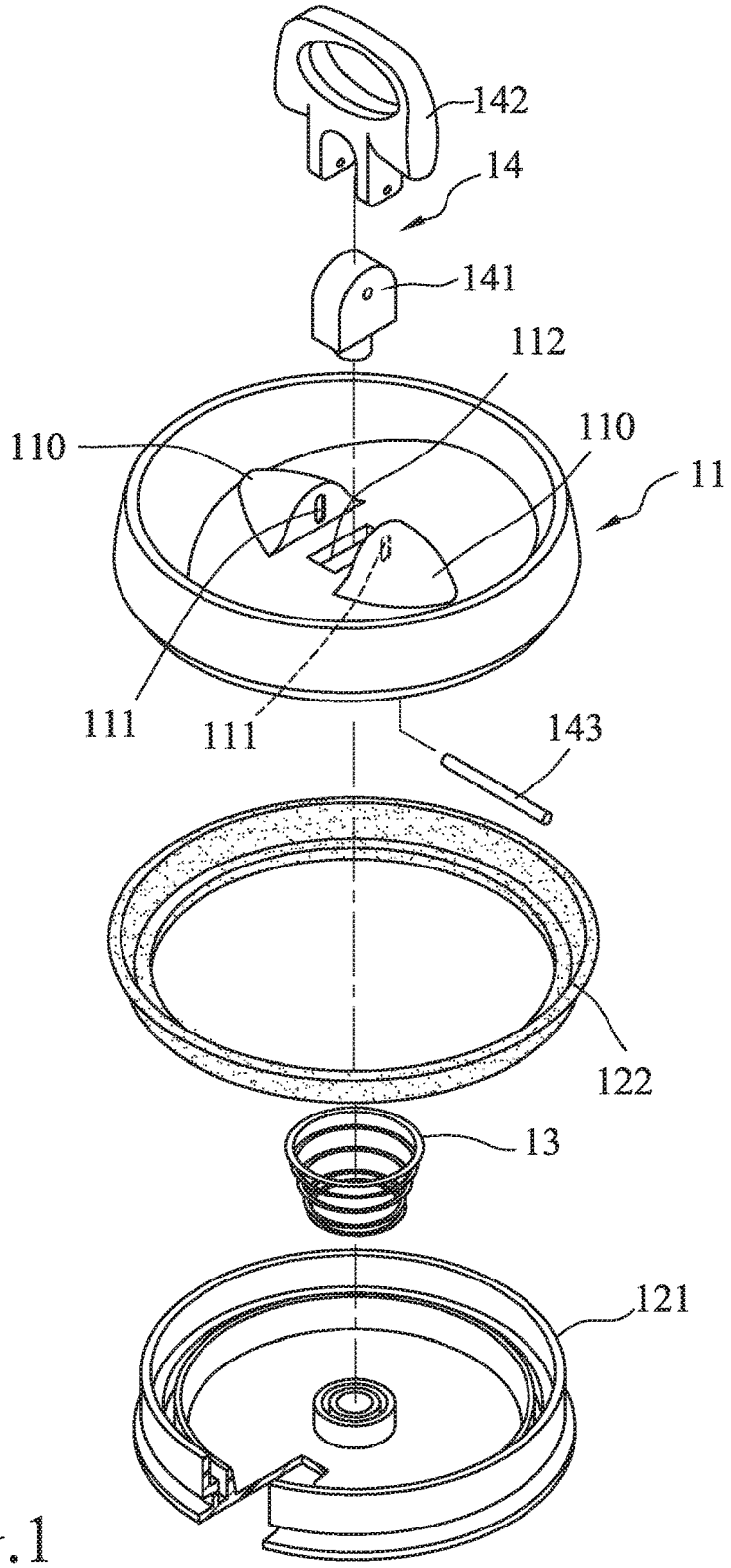
FIG.1 PRIOR ART
FIG. 1 is an exploded perspective view of a conventional sealing cap disclosed in Taiwanese Invention Patent No. I418508.
Figure 2:
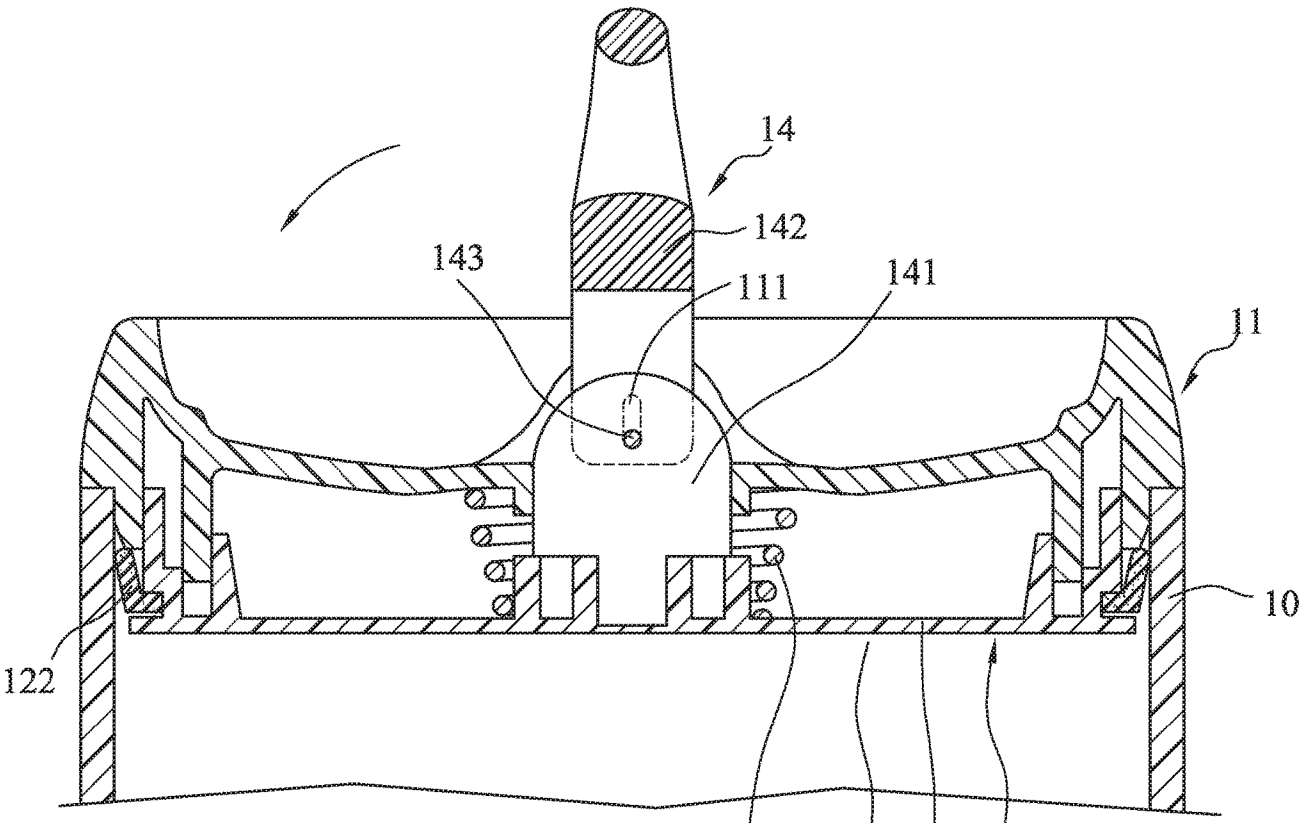
FIG.2 PRIOR ART
FIG. 2 is a fragmentary view, illustrating the conventional sealing cap in an unpressurizing state.
Figure 3:
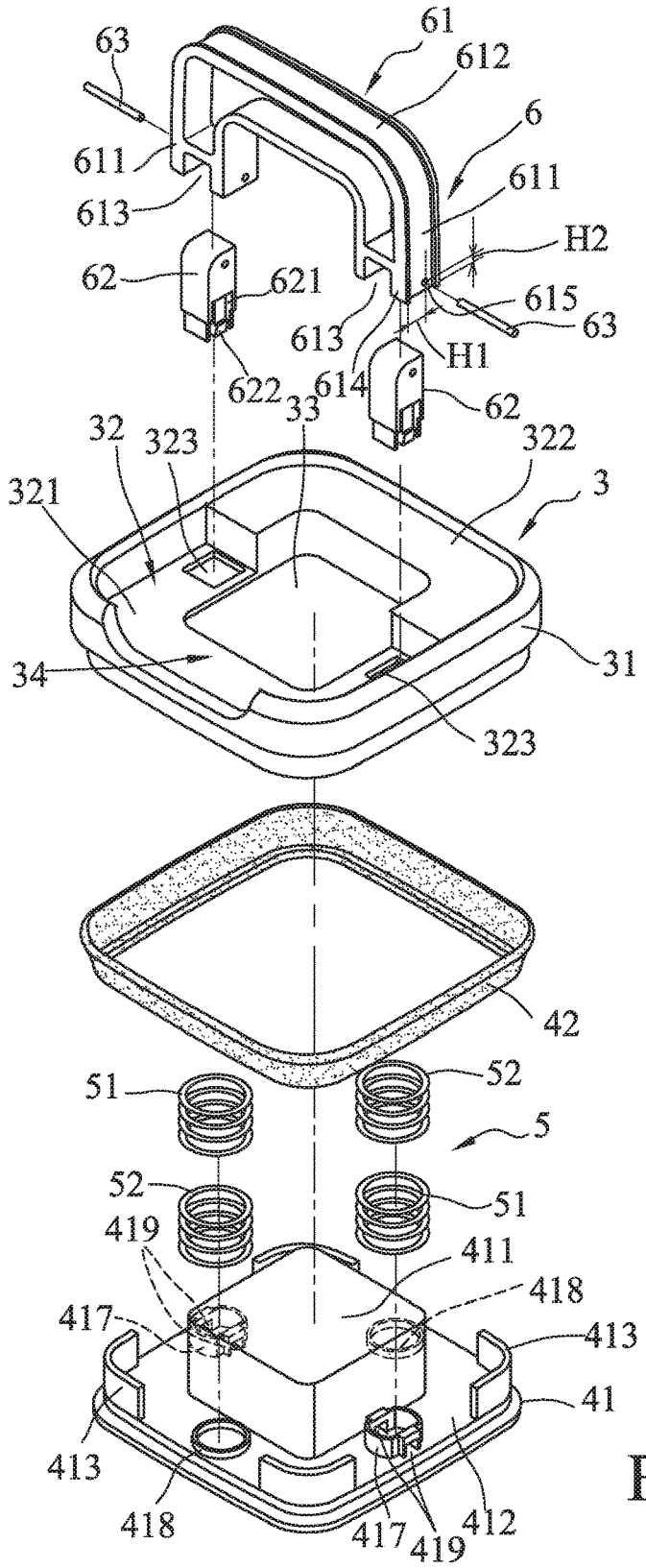
FIG. 3 is an exploded perspective view of a sealing cap according to an embodiment of the present disclosure.
Figure 4:
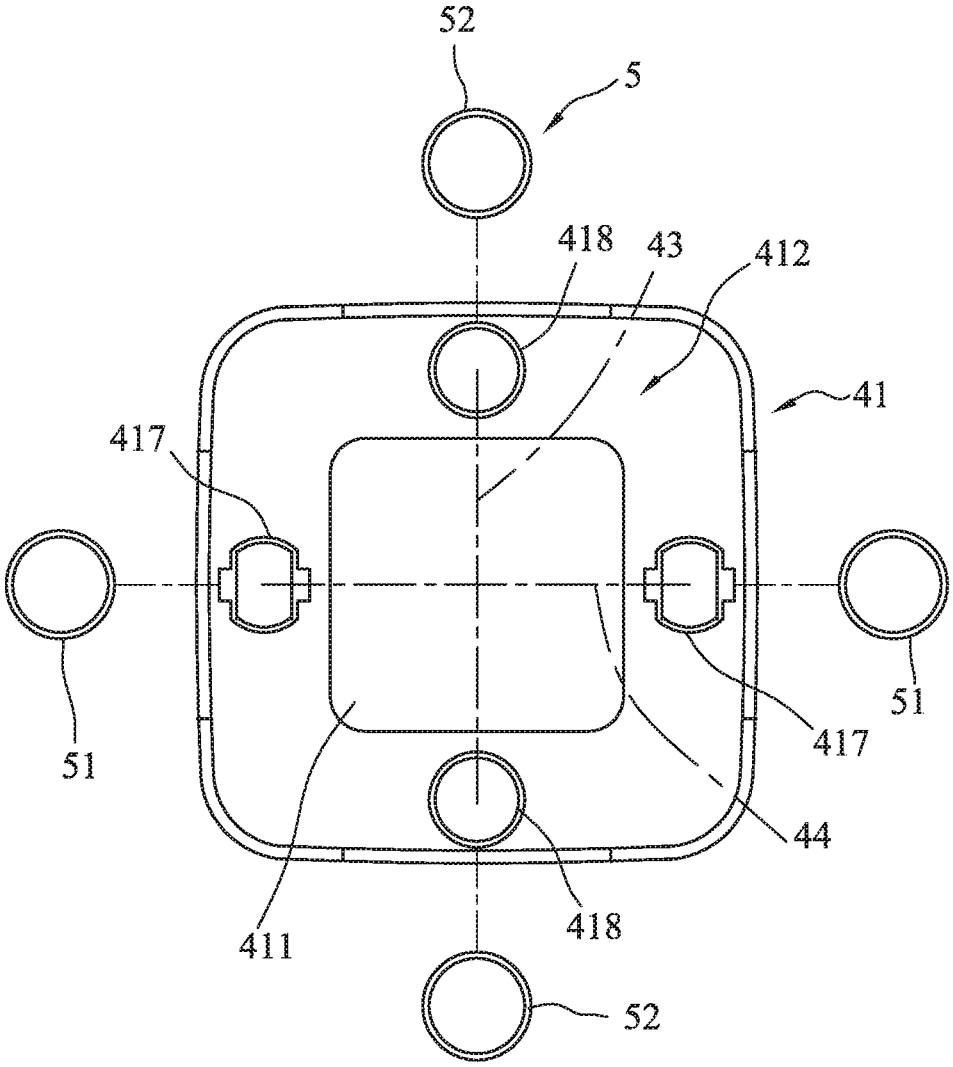
FIG. 4 is a top view, illustrating an inner cap and a resilient unit of the embodiment.
Figure 5:
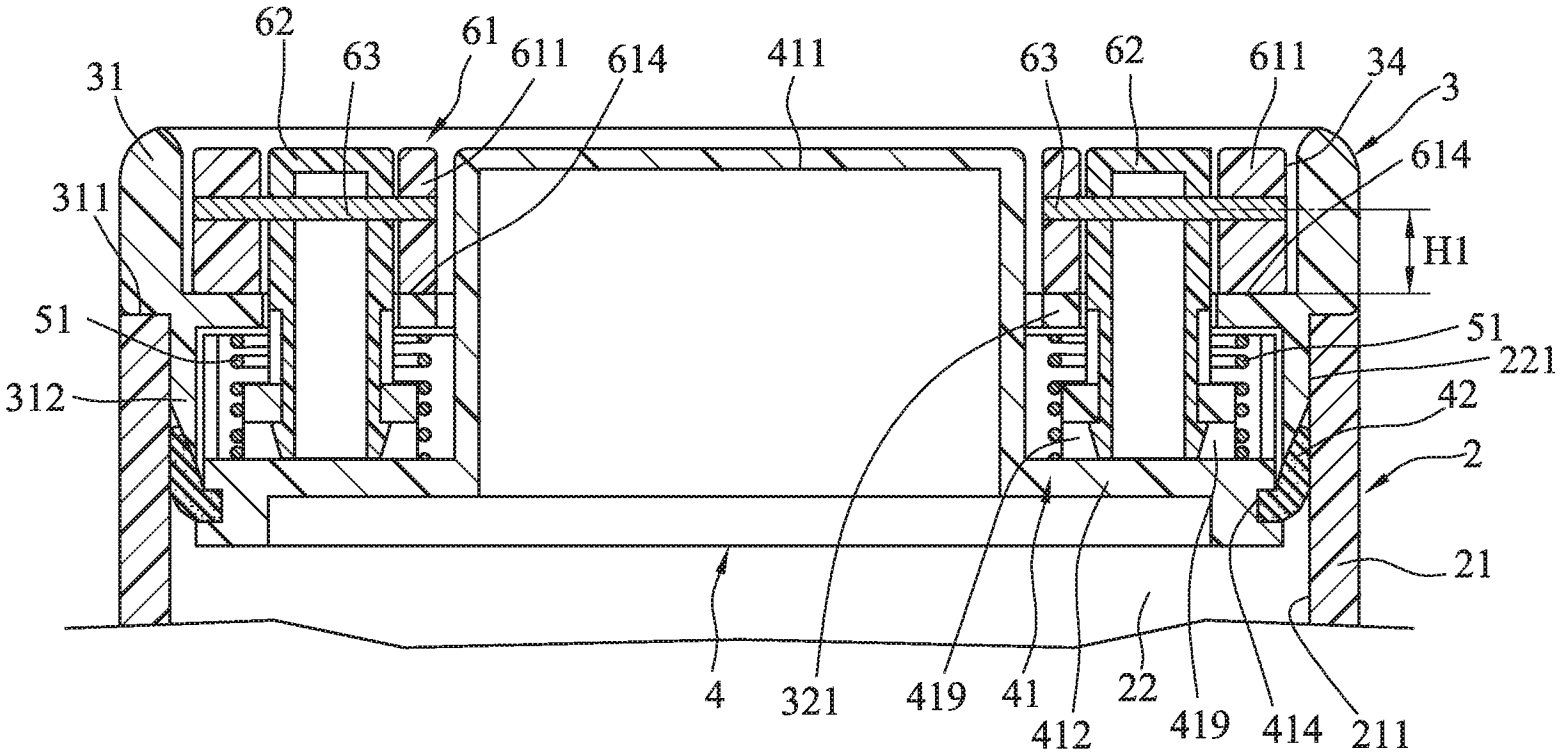
FIG. 5 is a fragmentary sectional view of the embodiment, illustrating the sealing cap in a pressurizing state.

Referring to FIGS. 3 to 5, a sealing cap according to an embodiment of the present disclosure is to be removably attached to a container 2. The container 2 has a surrounding wall 21 that has a surrounding inner surface 211 defining an accommodating space 22 with a top opening 221 at a top end of the container 2. The sealing cap includes an outer cap 3, an inner cap 41, an air-tight gasket 42, a resilient unit 5 and an operator unit 6.

In this embodiment, the outer cap 3 is square-shaped and configured to be disposed on the container 2. The outer cap 3 includes an outer cap peripheral wall 31, an outer cap mounting plate 32 that is disposed transversely inside and connected to the outer cap peripheral wall 31 and that has two spaced-apart through holes 323, and a central positioning hole 33 disposed between the through holes 323. The outer cap peripheral wall 31 has an annular shoulder portion 311 facing downward and abutting against the top end of the container 2, and an annular neck portion 312 extending downward from an inner end of the annular shoulder portion 311. In addition, the outer cap mounting plate is a stepped structure and has a U-shaped non-thickened part 321, a U-shaped thickened part 322, and an indented receiving space 34 which is formed above the non-thickened part 321 within the outer cap peripheral wall 31. The U-shaped non-thickened and thickened parts 321, 322 cooperatively form a square loop that surrounds the central positioning hole 323. The through holes 323 are symmetrically and diametrically opposite to each other with respect to the center of the central positioning hole 33, and are formed in the non-thickened part 321 adjacent the shoulder surfaces of the thickened part 322.

The air-tight gasket 42 is sleeved around the inner cap 41. In this embodiment, the inner cap 41 has an inner cap base wall 412, a central protruding portion 411, four corner walls 413, two diametrically opposite engagement members 417 and two spring seats 418. The inner cap base wall 412 has a positioning recess 414 extending annularly along a periphery of the inner cap base wall 412 to receive and position one end of the air-tight gasket 42 therein. The central protruding portion 411 projects from the inner cap base wall 412 into the central positioning hole 33. The corner walls 413 project respectively and upwardly from four corners of the inner cap base wall 412.

The inner cap 41 is movably connected beneath the outer cap 3. In particular, the annular neck portion 312 of the outer cap 3 is slidably sleeved around the corner walls 413 of the inner cap 41 such that the inner cap 41 is movable upward or downward relative to the outer cap 3. A portion of the air-tight gasket 42 extends around the annular neck portion 312 of the outer cap 3.

The diametrically opposite engagement members 417 and the spring seats 418 project from the inner cap base wall 412 respectively at four sides of the central protruding portion 411. The spring seats 418 are opposite to each other along a first diametrical line 43 with respect to the center of the central protruding portion 411, or the center of the inner cap base wall 412. The engagement members 417 are opposite to each other along a second diametrical line 44 perpendicular to the first diametrical line 43. The engagement members 417 and the spring seats 418 are arranged angularly around the central protruding portion 411. In this embodiment, each of the engagement members 417 has two spaced-apart engagement holes 419 aligned with each other along the second diametrical line 44.

The resilient unit 5 includes two spaced-apart first resilient members 51 respectively sleeved on the engagement members 417 and abuttingly disposed between the outer and inner caps 3, 41, and two second resilient members 52 respectively sleeved on the spring seats 418 and abuttingly disposed between the outer and inner caps 3, 41. As such, the first resilient members 51 are symmetrically and angularly spaced apart from the second resilient members 52 in an equidistant manner.

The operator unit 6 includes two spaced-apart connectors 62 that extend through the outer cap 3 and that are connected to the inner cap 41, and an operator 61 that is disposed above the outer cap 3 and that is pivotally connected to the connectors 62.

The connectors 62 respectively extend through the through holes 323 and are respectively disposed at two diametrically opposite positions with respect to a center of the inner cap 41. Each connector 62 has a connector portion 621 that extend through a respective one of the through holes 323 and that is engaged with a respective one of the engagement members 417. In this embodiment, the connector portion 621 has two spaced-apart barbs 622 engaged respectively with the engagement holes 419 of the respective one of the engagement members 417.

The operator 61 is U-shaped, and has two spaced-apart pivot arms 611 respectively connected to the connectors 62, and an intermediate portion 612 bridging the pivot arms 611. Each pivot arm 611 has an abutting first surface 614, an abutting second surface 615 transverse to the first surface 614, a pivot recess 613 transversely extending through the first surface 614 and pivotally receiving a corresponding one of the connectors 62, and a pivot pin 63 pivotally connecting one of the pivot arms 611 to the corresponding one of the connectors 62. The first surface 614 has a first distance (H1) from the pivot pin 63. The second surface 615 has a second distance (H2) from the pivot pin 63. The first distance (H1) is greater than the second distance (H2).

The operator 61 is operable to move the inner cap 41 relative to the outer cap 3 between a pressurizing position, where the inner cap 41 pressurizes the air-tight gasket 42 against the container 2, and an unpressurizing position, where the inner cap 41 unpressurizes the air-tight gasket 42 against the container 2.

As shown in FIG. 5, when the operator 61 is operated to rotate downward into the receiving space 34 of the outer cap 3, the first surfaces 614 of the pivot arms 611 symmetrically abut against the non-thickened part 321 of the outer cap mounting plate 32, and the inner cap 41 is in the pressurizing position. Since the first distance (H1) is greater than the second distance (H2), the inner cap 41 is moved upwardly relative to the outer cap 3 by the connectors 62, and the first and second resilient members 51, 52 are compressed uniformly between the outer and inner caps 3, 41. Meanwhile, the inner cap 41 pressurizes the air-tight gasket 42 so that the air-tight gasket 42 deforms, expands outward and abuts against the container 2.

Figure 6:
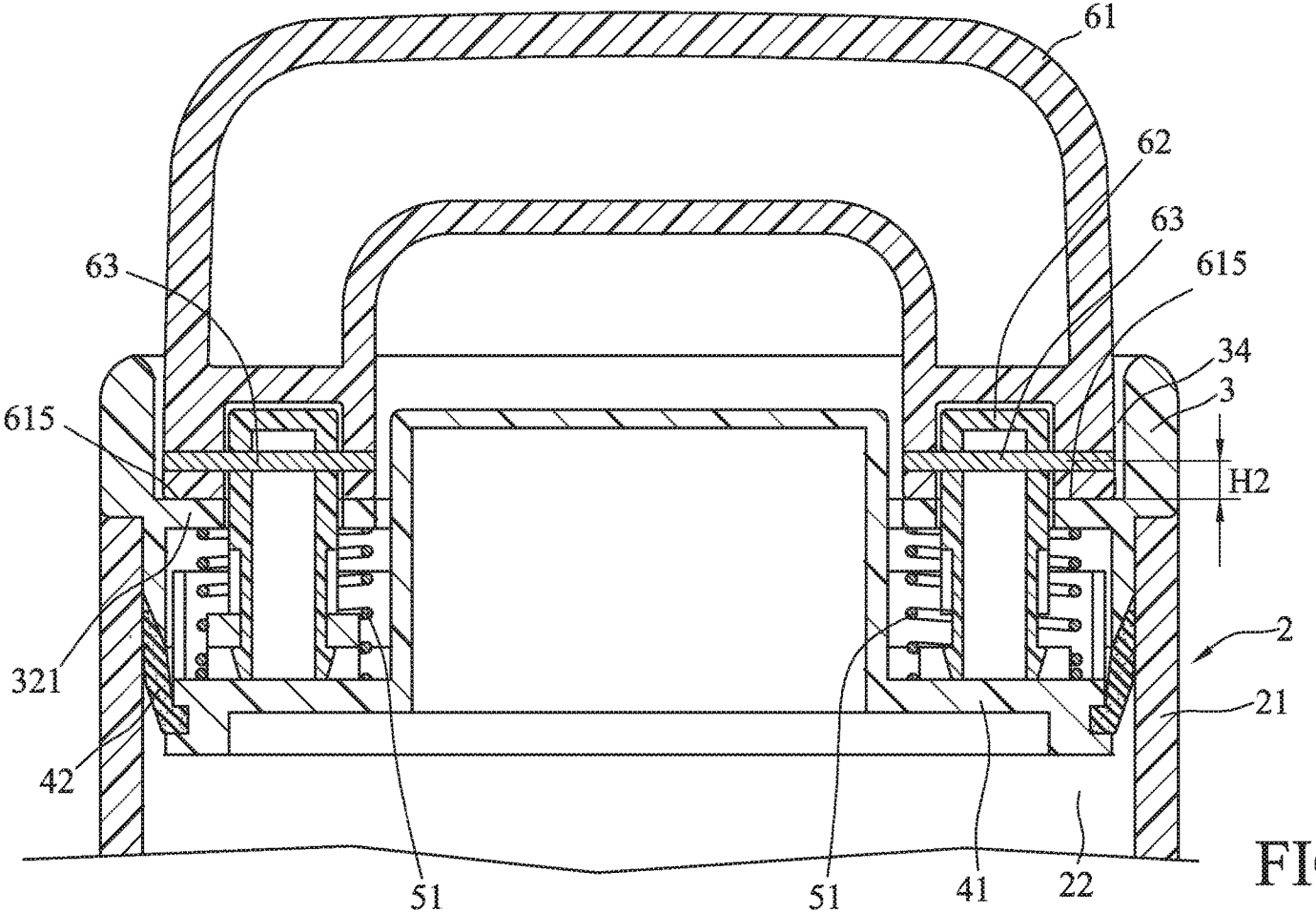
FIG. 6 is a fragmentary sectional view of the embodiment, illustrating the sealing cap in an unpressurizing state.

Referring to FIG. 6, when the operator 61 is operated to rotate upward and move away from the receiving space 34, the second surfaces 615 of the pivot arms 611 abut against the non-thickened part 321 of the outer cap mounting plate 32, and the inner cap 41 is in the unpressurizing position. Since the second distance (H2) is smaller than the first distance (H1), and since the first and second resilient members 51, 52 abut against and urge the outer and inner caps 3, 41, the distance between the outer and inner caps 3, 41 is increased. Accordingly, the inner cap 41 moves downward and unpressurizes the air-tight gasket 42 against the container 2.

As described hereinbefore, when the inner cap 41 is moved relative to the outer cap 3 between the pressuring and unpressurizing positions, since the first and second resilient members 51, 52 are subjected to different levels of compression force between the outer and inner caps 3, 41, a distance between the outer and inner caps 3, 41 is changed. During the change in distance between the outer and inner caps 3, 41, since the first and second resilient members 51, 52 are symmetrically disposed and equidistantly spaced apart from each other with respect to the central protruding portion 411 of the inner cap 41, and since connectors 62 are symmetrically connected to the inner cap 41 and are respectively limited by the through holes 323 of the outer cap 3, the forces exerted on the outer and inner caps 3, 41 can be uniformed, and the relative movement of the outer and inner caps 3, 41 can be symmetrical. Therefore, the inner cap 41 may be prevented from tilting relative to the outer cap 3. As such, the sealing cap of the present disclosure is able to provide the inner cap 41 with a balancing force that uniformly pressurizes the air-tight gasket 42 to effectively seal the container 2.

In the description above, for the purposes of explanation, numerous specific details have been set forth in order to provide a thorough understanding of the embodiment. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A sealing cap to be removably attached to a container comprising:

an outer cap configured to be disposed on the container, said outer cap has two spaced-apart through holes;

an inner cap movably connected beneath said outer cap, said inner cap has an inner cap base wall, and two diametrically opposite engagement members projecting from said inner cap base wall;

an air-tight gasket sleeved around said inner cap;

a resilient unit including two spaced-apart first resilient members abuttingly disposed between said outer and inner caps, said first resilient members are respectively sleeved on said engagement members; and an operator unit including two spaced-apart connectors that extend through said outer cap and that are connected to said inner cap, and an operator that is disposed above said outer cap and that is pivotally connected to said connectors, said connectors respectively extending through said through holes and being respectively disposed at two diametrically opposite positions with respect to a center of said inner cap, each of said connectors having a connector portion that extends through a respective one of said through holes and that is engaged with a respective one of said engagement members, said operator being U-shaped, and having two spaced-apart pivot arms respectively connected to said connectors, and an intermediate portion bridging said pivot arms, said operator being operable to move said inner cap relative to said outer cap between a pressurizing position, where said inner cap pressurizes said air-tight gasket against the container, and an unpressurizing position, where said inner cap unpressurizes said air-tight gasket against the container.

2. The sealing cap as claimed in claim 1, wherein each of said engagement members has two spaced-apart engagement holes, said connector portion of each of said connectors having two spaced-apart barbs engaged respectively with said engagement holes of the respective one of said engagement members.

3. The sealing cap as claimed in claim 1, wherein:

said inner cap further has two spring seats projecting from said inner cap base wall and opposite to each other along a first diametrical line with respect to the center of said inner cap base wall, said engagement members being opposite to each other along a second diametrical line perpendicular to said first diametrical line; and said resilient unit further includes two second resilient members respectively sleeved on said spring seats and abuttingly disposed between said outer and inner caps.

4. The sealing cap as claimed in claim 3, wherein:

said outer cap further has an outer cap peripheral wall configured to abut against a top end of the container, an outer cap mounting plate that is disposed transversely within and connected to said outer cap peripheral wall and that has said through holes, and a central positioning hole disposed between said through holes; and said inner cap further has a central protruding portion projecting from said inner cap base wall into said central positioning hole, said engagement members and said spring seats being arranged angularly around said central protruding portion.

5. The sealing cap as claimed in claim 4, wherein said outer cap further has an indented receiving space formed above said outer cap mounting plate within said outer cap peripheral wall to receive said operator when said inner cap is in the pressurizing position.

6. The sealing cap as claimed in claim 1, wherein said resilient unit further includes two spaced-apart second resilient members abuttingly disposed between said outer and inner caps, said first resilient members being angularly spaced apart from said second resilient members.

7. The sealing cap as claimed in claim 1, wherein:

each of said pivot arms has an abutting first surface, an abutting second surface transverse to said first surface, and a pivot pin pivotally connecting one of said pivot arms to one of said connectors, said first surface having a first distance from said pivot pin, said second surface having a second distance from said pivot pin, said first distance being greater than said second distance;

said first surface abuts against said outer cap mounting plate when said inner cap is in the pressurizing position; and said second surface abuts against said outer cap mounting plate when said inner cap is in the unpressurizing position.

* * * * *